US007048032B2

(12) United States Patent
Hohenbichler et al.

(10) Patent No.: US 7,048,032 B2
(45) Date of Patent: May 23, 2006

(54) DEVICE FOR CONTINUOUSLY CASTING MOLTEN METALS

(75) Inventors: Gerald Hohenbichler, Kronstorf (AT); Michael Zahedi, Linz (AT); Karl Klima, Pucking (AT); Thomas Stepanek, Vienna (AT); Guido Stebner, Essen (DE); Wilhelm Mankau, Niderkrüchten (DE); Werner Schümers, Meerbusch (DE)

(73) Assignees: Voest Alpine Industrieanlagenbau GmbH & Co. (AT); Thyssenkrupp Nirosta GmbH (DE)

( * ) Notice: Subject to any disclaimer, the term of this patent is extended or adjusted under 35 U.S.C. 154(b) by 0 days.

(21) Appl. No.: 10/505,801

(22) PCT Filed: Feb. 25, 2003

(86) PCT No.: PCT/EP03/01951

§ 371 (c)(1),
(2), (4) Date: Dec. 2, 2004

(87) PCT Pub. No.: WO03/072281

PCT Pub. Date: Sep. 4, 2003

(65) Prior Publication Data

US 2005/0077024 A1 Apr. 14, 2005

(30) Foreign Application Priority Data

Feb. 27, 2002 (AT) ..... A 303/2002

(51) Int. Cl.
*B22D 11/06* (2006.01)

(52) U.S. Cl. ..... 164/428; 164/480

(58) Field of Classification Search ..... 164/428, 164/480
See application file for complete search history.

(56) References Cited

U.S. PATENT DOCUMENTS

| | | | | |
|---|---|---|---|---|
| 5,201,363 | A | 4/1993 | Demarez et al. | |
| 5,584,337 | A | 12/1996 | Nakashima et al. | |
| 2004/0040689 | A1 * | 3/2004 | Marti et al. | 164/480 |

FOREIGN PATENT DOCUMENTS

| | | | |
|---|---|---|---|
| EP | 0 707 908 | | 4/1996 |
| EP | 0 776 984 | | 6/1997 |
| EP | 0 780 177 | | 6/1997 |
| EP | 0 830 223 | | 3/1998 |
| EP | 0 903 190 | | 3/1999 |
| EP | 0 947 261 | | 10/1999 |
| EP | 1092490 | * | 4/2001 |
| JP | 58 097467 | | 6/1983 |
| JP | 63 238953 | | 10/1988 |
| JP | 3-291135 | * | 12/1991 |
| WO | WO 95/09707 | | 4/1995 |
| WO | WO 01 39914 | | 6/2001 |
| WO | WO 02 24379 | | 3/2002 |

* cited by examiner

*Primary Examiner*—Kuang Y. Lin
(74) *Attorney, Agent, or Firm*—Ostrolenk, Faber, Gerb & Soffen, LLP

(57) ABSTRACT

A device for casting a molten metal comprising casting rolls and a housing arranged downstream from the rolls for the cast strip. The aim of the invention is to be able to replace the casting rolls with minimum mounting, and to simultaneously reduce the thermal load of the casting rolls and the adjacent units. A casting roll screen which forms a displaceable structural unit with a frame used to support the casting rolls.

37 Claims, 5 Drawing Sheets

DEVICE FOR CONTINUOUSLY CASTING MOLTEN METALS

BACKGROUND OF THE INVENTION

The invention relates to an apparatus for continuously casting metal melt, preferably steel melt, to form cast strip.

When steel is being cast in two-roll casting machines, there are in each case two internally cooled casting rolls which rotate in opposite directions during the casting process, are arranged axially parallel and delimit the longitudinal sides of a casting gap formed between them. The casting gap is sealed laterally by side plates which are placed against the end sides of the casting rolls. In each case sufficient liquid melt for a melt pool to form above the casting gap is cast into this casting gap. Melt which passes out of this melt pool onto the casting rolls solidifies there and is conveyed into the casting gap by the casting rolls. The cast strip is formed in the casting gap from the strand shells formed in this way on the casting rolls and from melt which is still liquid, and this cast strip is then drawn off at the bottom of the casting gap and fed for further processing.

Since the cast strip is at high temperatures when it leaves the casting gap, scale forms on its surface on contact with oxygen, which represents a difficulty for the continuous further processing of the strip. In particular, the scale has an adverse effect on the working result of the in-line hot-rolling which is carried out after the strip has been cast.

Various solutions have been proposed for the purpose of reducing the extent to which scale is formed. For example, it is known from U.S. Pat. No. 5,584,337, EP-A 776 984, EP-A 780 177 and EP-B 830 223 to arrange a housing in which a reduced-oxygen, inert gas atmosphere is maintained during casting operation beneath the casting gap in apparatuses of the type in question. In particular, it is also known from EP-A 780 177 to move the housing directly onto the housing and to produce an airtight contact by means of a touching seal.

In addition to the problem of scale formation, a further difficulty when the known two-roll casting machine is operating is that the thermal radiation emitted from the cast strip leads to considerable heating of the components of the two-roll casting machine which are within the region of the radiation. This heating leads, on the one hand, to deformation of the carriers which carry the casting rolls. This deformation makes it difficult to ensure dimensional accuracy of the cast strip in particular if the corresponding carriers are designed as a movable frame to allow the casting rolls to be changed. On the other hand, the high temperatures in the region of the two-roll casting machine lead to considerable physical loading on the staff monitoring casting operation on the casting floor.

Furthermore, the direct thermal radiation of the very hot strip emerging from the casting gap reduces the extent to which the casting-roll surface can be rapidly cooled, and the casting-roll surface also becomes soiled by dirt particles which may be present in the upwardly flowing hot gas masses beneath the two casting rolls.

In particular in the event of the casting rolls being changed as a result of a format change, with predominantly the strip width of the strip to be cast and therefore the dimension of the casting rolls (diameter, surface length) being altered, the geometric conditions for entry of the cast strip into the housing arranged immediately downstream also change. This also results in the need to change parts of this housing, thereby significantly increasing the time required for the format change.

SUMMARY OF THE INVENTION

Description of the Preferred Embodiments

The invention is based on the object of avoiding these drawbacks which have been described and of providing an apparatus of the type described in the introduction in which a casting roll change can be carried out with minimal fitting outlay during the roll change operation, and at the same time the loading on the casting rolls and the surrounding structure which carries them through heat emitted by the cast strip is reduced.

Working on the basis of the prior art explained in the introduction, this object is achieved by an apparatus for casting metal melt, preferably steel melt, to form. a cast strip, which apparatus is equipped with two casting rolls, which are arranged axially parallel, rotate in opposite directions during casting operation, delimit the longitudinal side of a casting gap formed between them and are supported rotatably in a frame which accommodates the casting-roll bearings, with a transport path for transporting away the cast strip emerging from the casting gap, and with a casting-roll shield, which is arranged beneath the two casting rolls and the casting gap, has an inlet opening for the cast strip and is carried by the frame which accommodates the casting-roll bearings and can be displaced between a working position and a waiting position.

The casting-roll shield provided in the apparatus according to the invention in this way allows particularly effective protection to be provided for the casting rolls, the components required to bear and operate them and all other units arranged in the vicinity of the casting rolls from rising gases which have been heated by the cast strip.

The casting-roll shield may in this case be directly or indirectly connected to the frame which receives the casting-roll bearings.

According to a first embodiment, the casting-roll bearings, which receive the casting rolls, are located on a frame, and the casting-roll shield adjoins the supporting frame. In this way, a compact assembly is formed, which per se can easily be manipulated between a working position and a waiting position.

According to a further embodiment, the casting-roll bearings, which receive the casting rolls, engage in a suspended manner on the frame, and the casting-roll shield is secured to the casting-roll bearings. This design variant likewise offers the advantages of a compact assembly.

As a result of the casting-roll shield being secured to the carrying frame, it is possible for the frame with the casting rolls and the casting-roll shield to be exchanged as a complete assembly in the event of a roll change. Therefore, after the frame has been transported out of a working position into a waiting position, it is possible to carry out maintenance work not only on the rolls themselves, but also on the casting-roll shield and the units provided at the casting-roll shield, for example for cooling the walls of the casting-roll shield and for blowing in the cooling gases. In the event of the dimensions of the casting rolls being changed, it is easy to simultaneously match the casting-roll shield to the dimensions of the casting rolls.

One configuration of the invention which is expedient with regard to the protective action of the thermal shield and with regard to reduced casting-roll soiling is characterized in that the casting-roll shield extends, in the style of a ridged roof, within the space which is delimited by the casting rolls and is present beneath the casting gap. In this configuration, the inlet opening for the cast strip emerging from the casting gap to pass through is preferably formed in the ridge region of the shield. Configuring the casting-roll shield in the style of a ridged roof in this manner, such that it is matched to the shape of the cast strip in the outlet region, makes it possible for both the casting roll and the units and components arranged in the vicinity thereof to be substantially completely shielded from the cast strip. One expedient configuration consists in the cross section of the inlet opening being matched to the cross section of the cast strip. If the local conditions do not permit such a close arrangement of rolls, casting-roll shield and cast strip, it is alternatively possible for the edges, extending axially parallel to the casting rolls, of the inlet opening of the casting-roll shield to be arranged so as to form a gap with respect to the casting rolls. In this case, the casting-roll shield, in the region of the casting rolls, merely forms a lateral boundary of the cooling zone, while their upper boundary is formed by the casting rolls themselves. The casting-roll shield additionally has walls which, in the region of the casting-roll end sides, extend parallel to the latter, so that at least the edges of these walls are arranged so as to form a gap with respect to the end sides of the casting rolls. The escape of hot gases from the casting-roll shield to the components of the two-roll casting machine which are to be protected is almost completely eliminated if a seal, which is preferably formed by a flexible, low-abrasion strip or brushes in contact with or at a distance of less than 4 mm from the casting-roll surface, is arranged between the edges of the casting-roll shield and the casting rolls.

If, in a manner known per se, there is a housing which surrounds the conveying path of the cast strip at least in sections, it is expedient if the casting-roll shield is fitted onto or forms part of a housing of this type.

In this case, the housing, together with the casting-roll shield, preferably surrounds the conveying path of the cast strip at least as far as a first pair of rolls, arranged in the conveying path, for conveying away or hot-rolling the strip. This configuration proves particularly expedient if an inert atmosphere is maintained in the housing in order to suppress the formation of scale.

If a housing adjoins the casting-roll shield, it is expedient, with regard to the possibility of simple, regular maintenance, for this casting-roll shield to be releasably connected to the housing. This is true in particular if the casting-roll shield is connected to a movable frame. In this case, a seal which is able to withstand the thermal loads occurring in the region of the two-roll casting machine should be present between the casting-roll shield and the housing. This can be effected by virtue of this seal being designed in the form of a sand-filled channel, in which the lower edge of the casting-roll shield is immersed after the casting-roll shield has been lowered onto the housing.

To allow the casting-roll change to be made such that it can be carried out particularly quickly and easily for the operating staff, the frame which supports the casting-roll bearings is equipped with a transport device, preferably a running mechanism, supported on a running track, for moving it between a working position or operating position and a waiting position and vice versa.

To enable this sequence of movements to be carried out efficiently, the casting-roll shield is separated from the seal arranged on the housing by virtue of the fact that the frame which supports the casting-roll bearings is designed such that its height can be adjusted with respect to the running track or running mechanism, preferably by a lifting or pivoting mechanism.

An arrangement of the changing device which can be realized quickly and has a high setting accuracy is provided if the frame, which is designed so that it can be raised and lowered by a lifting or pivoting mechanism, in the working position rests in a centered position on an intermediate plate, and to be displaced into a waiting position is moved into a position which is raised with respect to the intermediate plate. In this case, centering devices which reliably ensure centering in both the lateral direction and the transverse direction are used when the frame is being lowered onto the intermediate plate, in order to align the two components in an accurate position with respect to one another. It is preferable to provide centering devices which act independently of one another in each of the two directions to achieve this centering action.

The shielding with respect to rising hot gases acts particularly efficiently if this casting-roll shield delimits a cooling zone, in which the temperature during casting operation is lower than the temperature of the gases heated by the cast strip. As a result, a zone in which the temperature is deliberately lowered is formed in the vicinity of the outlet region of the casting gap. This cooling interrupts the natural, thermally induced flow (stack effect), in which the gases which have been heated by the cast strip as it is transported along the conveying path rise in the opposite direction to which the strip is being conveyed. In an apparatus designed in accordance with the invention, therefore, the cooling zone forms a barrier preventing the hot gases which have been heated by the strip from reaching the components required to support the casting rolls. This effectively counteracts the stack effect which is inevitable in conventional strip-casting apparatuses on account of the heating of the gases. In this way, the casting-roll shield constitutes a physical obstacle interrupting the flow of the hot gases to the casting rolls or a working platform which may be present, for example, in the region of the casting rolls. At the same time, the shield is available for targeted cooling of the gases present in the space which it surrounds. In the same way, the casting-roll shield, in combination with cooling of the gases in the cooling zone, leads to a significant reduction in danger to the staff deployed in the region of the casting rolls.

A cooling zone can be formed in the region delimited by the casting-roll shield, by way of example, by at least one of the walls of the casting-roll shield being connected to a cooling supply device. Furthermore, the formation of a cooling zone is realized by virtue of at least one of the walls of the casting-roll shield being fluid-cooled. For this purpose, the cooled wall has at least one cooling passage through which the cooling fluid flows during casting operation. Liquid cooling of this type ensures that the heat acting on the casting-roll shield is dissipated quickly and effectively. At the same time, the cooling of the casting-roll shield leads to intensive cooling of the gases impinging on the casting-roll shield, which mix with the hot gases flowing into the region delimited by the shield, so that they too are cooled and a zone which is at a lower temperature is established.

Moreover, the formation of the cooling zone can be supported particularly effectively by providing at least one device for blowing cooling gas into the cooling zone. In this context, the action of the cooling gas can be additionally improved if the flow of cooling gas blown into the cooling zone is directed substantially in the opposite direction to the direction of flow of the gases heated by the cast strip. This orientation of the cooling-gas flow leads to intensive mixing of the hot gases with the cooling gas, so that a particularly effective cooling zone is built up within a short time, and hot gases are particularly reliably prevented from rising up above the casting-roll shield. Furthermore, the effectiveness of the cooling-gas flow can be enhanced by this flow sweeping over the surface of the cast strip. This cools not only the rising gases which have been heated by the cast strip but also the strip itself, reducing the thermal radiation which it emits, so that the gases which come into contact with the strip along the further conveying path are heated to a lesser extent. At the same time, the gas stream directed onto the strip surface, in addition to the thermal barrier, also forms a flow barrier, which likewise suppresses the extent to which hot gases rise up directly at the surface of the strip.

The cooling of the strip alone achieved in the region of the cooling zone reduces the quantity of scale formed on the strip surface during transporting of the strip. The scale formation can be suppressed further in situations in which an inert cooling gas is blown into the cooling region. Blowing in an inert gas not only cools the strip surface but also effectively counteracts contact of the surface of the cast strip with atmospheric oxygen and, as a corollary effect, the formation of extensive layers of scale on the strip surface.

Oxidation of the strip, which is undesirable for many applications, can be counteracted by a cool gas with a reducing action being blown into the cooling zone as an alternative or in addition to inert gas being blown in.

Independent of the shape of the casting-roll shield, it may be expedient if, in the region of the inlet opening, there are in each case nozzles from which a stream of gas which prevents gas from escaping from the inlet opening emerges in casting operation. If the edges of the inlet opening closely surround the cast strip leaving the casting gap, this can be realized, for example, by a gas stream being directed onto the strip in the manner of a gas jet cutter. On the other hand, if the inlet opening is sealed off with respect to the casting rolls, a gas jet can in a corresponding way be directed onto the casting rolls. For this purpose, depending on the local conditions, it is possible to use round-jet nozzles or fan-jet nozzles which are distributed over the width of the strip or casting rolls and the jets from which are assigned to one another in such a way that gases, in particular air, cannot be sucked in from the area surrounding the apparatus into the cooling zone separated from the casting-roll shield.

A further expedient configuration of the casting-roll shield consists in the casting-roll shield being covered with refractory material on its surfaces assigned to the cast strip, in order to boost its heat-insulating action.

Moreover, the loading on the units and components of the two-roll casting apparatus can be further reduced by there being an extractor device for extracting the gases heated by the cast strip. If there is a housing encapsulating the transport path of the cast strip, the housing may have an extraction opening, to which the extractor device is connected.

BRIEF DESCRIPTION OF THE DRAWINGS

Further advantageous configurations of the invention are explained in more detail below on the basis of a drawing illustrating an exemplary embodiment. In the drawing.

Figure 1:
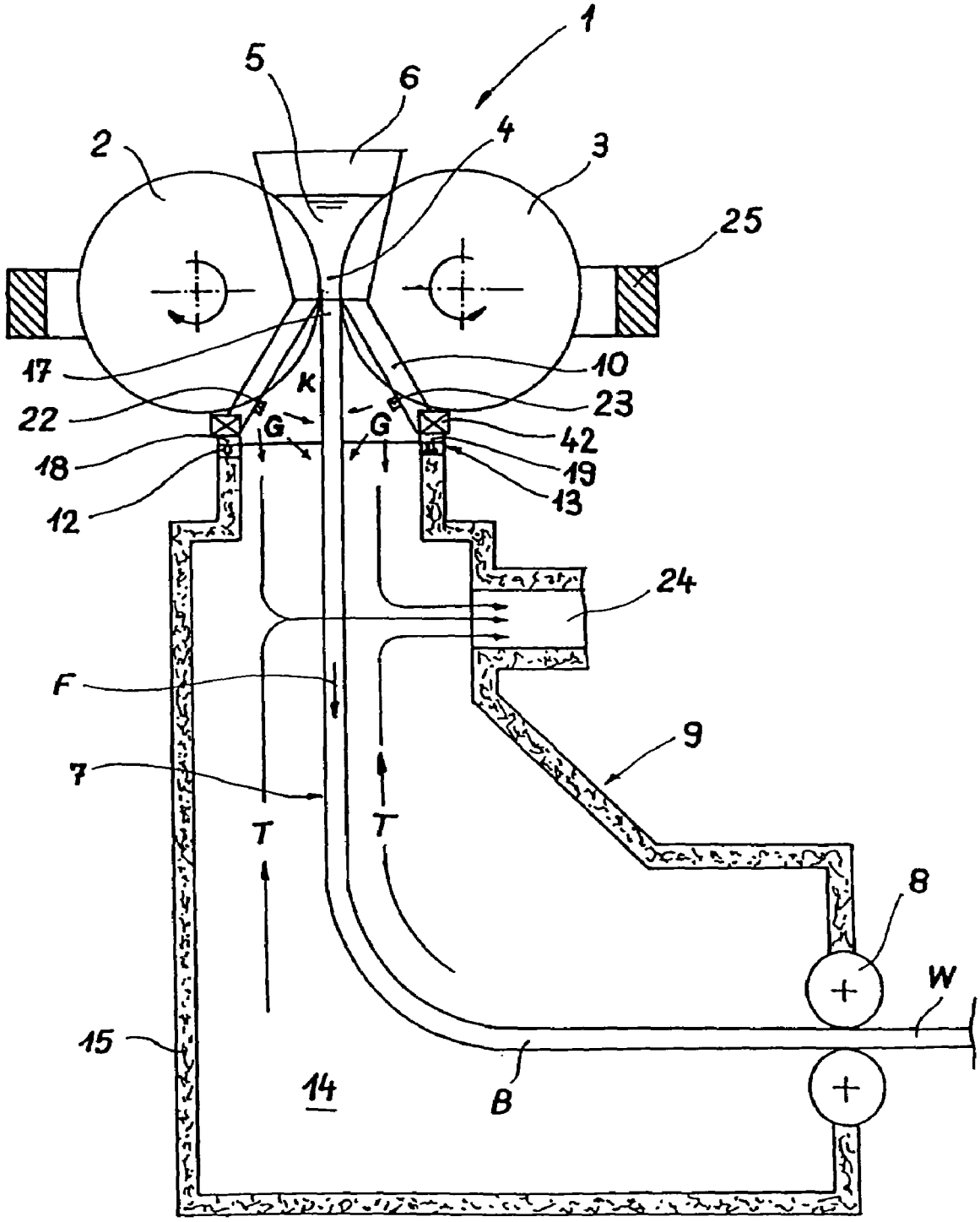
FIG. 1 diagrammatically depicts an apparatus for casting steel melt to form cast strip in the form of a first longitudinal section, FIG. 2 diagrammatically depicts the apparatus for casting steel melt in the form of a second longitudinal section, FIGS. 3*a* and 3*b* diagrammatically depict a first embodiment of the apparatus according to the invention for casting steel melt in the working position and in the waiting position, FIG. 4 diagrammatically depicts the configuration of the casting-roll shield in the form of a ridged roof, as a detail from FIGS. 3*a* and 3*b*, FIG. 5 diagrammatically depicts a second embodiment of the apparatus according to the invention for casting steel melt.
Figure 2:
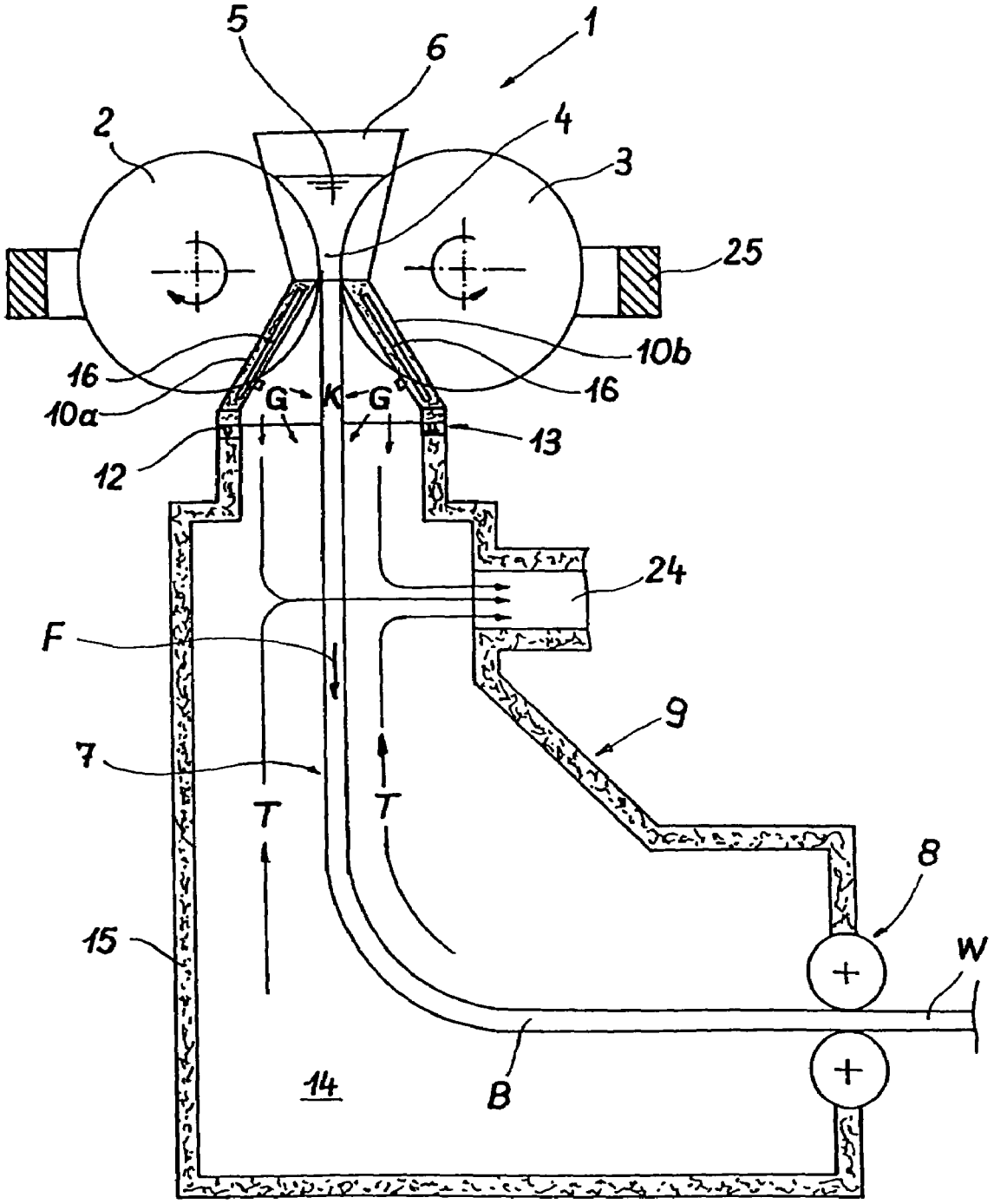

The apparatus 1, designed as a two-roll casting installation, for casting steel melt to form a cast steel strip B, as diagrammatically depicted in FIGS. 1 and 2, has two casting rolls 2, 3 which are arranged axially parallel to one another, rotate in opposite directions to one another, delimit the longitudinal sides of a casting gap 4, which is formed between them, and of the melt pool 5, which is arranged above the casting gap and into which the steel melt is fed from a tundish or casting ladle (not shown). The two lateral transverse sides of the casting gap 4, which are devoid of the casting rolls 2, 3, and of the melt pool 5 are in each case sealed off by side seals 6 which can be pressed onto the end sides of the casting rolls and just one of which is diagrammatically depicted. During casting, the casting rolls 2, 3 are continuously cooled by a flow of cooling water.

The cast steel strip B which is drawn out of the casting gap 4 is transported over a conveying path 7 to a hot-rolling stand 8 or a driving-roll stand, in which it is continuously hot-rolled to form a hot strip W of a defined final thickness. The conveying path 7 has a first section, which runs substantially vertically from the casting gap 4 and then merges, over a bend, into a second section, which leads to the hot-rolling stand 8 and runs substantially horizontally.

As far as the hot-rolling stand 8, the conveying path 7 is substantially completely surrounded by a housing 9, which shields it from the environment, so that the hot-rolled hot strip W only comes into direct contact with ambient air outside the housing. The casting-roll shield 10 assigned to the casting rolls 2, 3 is fitted releasably onto the upper edge of the housing 9, which is significantly larger than the casting-roll shield 10. For this purpose, a sand-filled channel 12, in which the lower edge region of the casting-roll shield 10 is placed, is formed integrally on the upper edge of the housing 9. The channel 12, together with the sand which it contains, forms a seal 13, at which the sand contained in the channel 12 ensures that no ambient air enters the interior space 14 surrounded by the housing 9 in the region of the channel 12.

Both the casting-roll shield 10 and the housing 9 are lined with a layer 15 of refractory material on the inner side assigned to the conveying path 7. The layer 15 reduces the thermal loading on the outer wall, consisting of steel, for example, of the housing 9. Furthermore, the refractory layer 15 also forms an insulation, which reduces the thermal radiation acting on the surroundings from the housing 9.

The casting-roll shield 10 is designed in the form of ridged roof, in such a manner that its walls 10*a*, 10*b* assigned to the respective casting rolls 2, 3 are designed so as to taper to a point toward one another in the direction of the casting gap 4, extending as far as just below the casting rolls 2, 3. At the edge region assigned to the housing 9, the casting-roll shield 10 has a frame section of low height, by means of which it is seated in the channel 12. The housing 9 and, with it, the casting-roll shield 10 in this case extend laterally beyond the width of the cast steel strip B, with the housing 9 being closed in its part which protrudes beyond the width of the casting rolls 2, 3.

In the part which projects beyond the width of the casting rolls 2, 3, cooling passages 16, through which, in casting operation, a stream of cooling water is passed continuously, are formed integrally into the walls 10*a*, 10*b* of the casting-roll shield 10. In this way, the walls 10*a*, 10*b* are cooled at least as well as the casting rolls 2, 3. (FIG. 2).

An inlet opening 17 is formed in the casting-roll shield 10 in the region of the casting rolls 2, 3, and the cast steel strip B subsequently enters the housing 9 through this inlet opening 17. The upper edges 18, 19 formed on the frame section are in each case arranged fan-jet nozzles 20, 21, from which inert gas is blown onto the respective casting rolls 2 and 3 in the manner of an air cutter. This produces contactless sealing of the gap which is present or of the short distance which is required between the upper edges 18, 19 and the casting rolls 2, 3 while at the same time not restricting the mobility of the casting rolls 2, 3, thereby preventing ambient air from penetrating into the housing 9 (FIG. 1).

Figure 4:
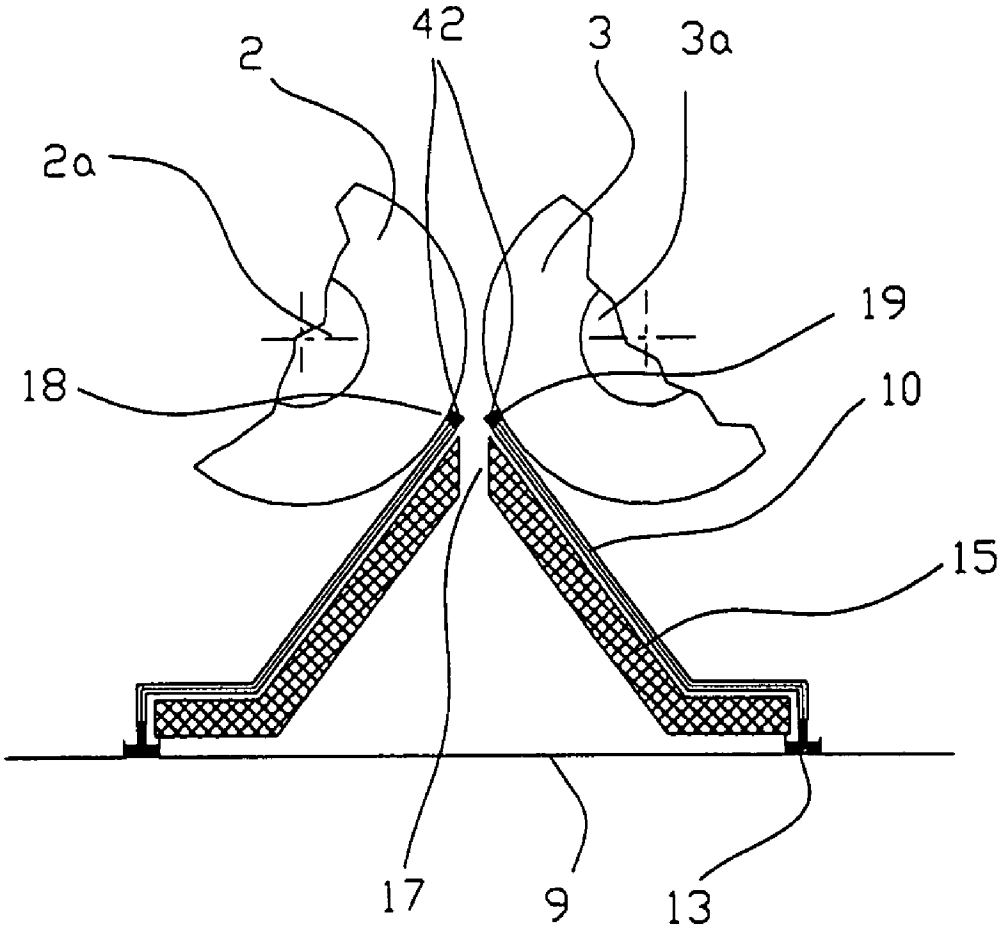

The gap which is present between the upper edges 18, 19 and the casting rolls 2, 3 parallel to their axial direction can alternatively be blocked off to escaping hot gases by a seal 42 which is formed by a flexible strip or brushes touching the casting-roll surface (FIG. 4).

Figure 3A:
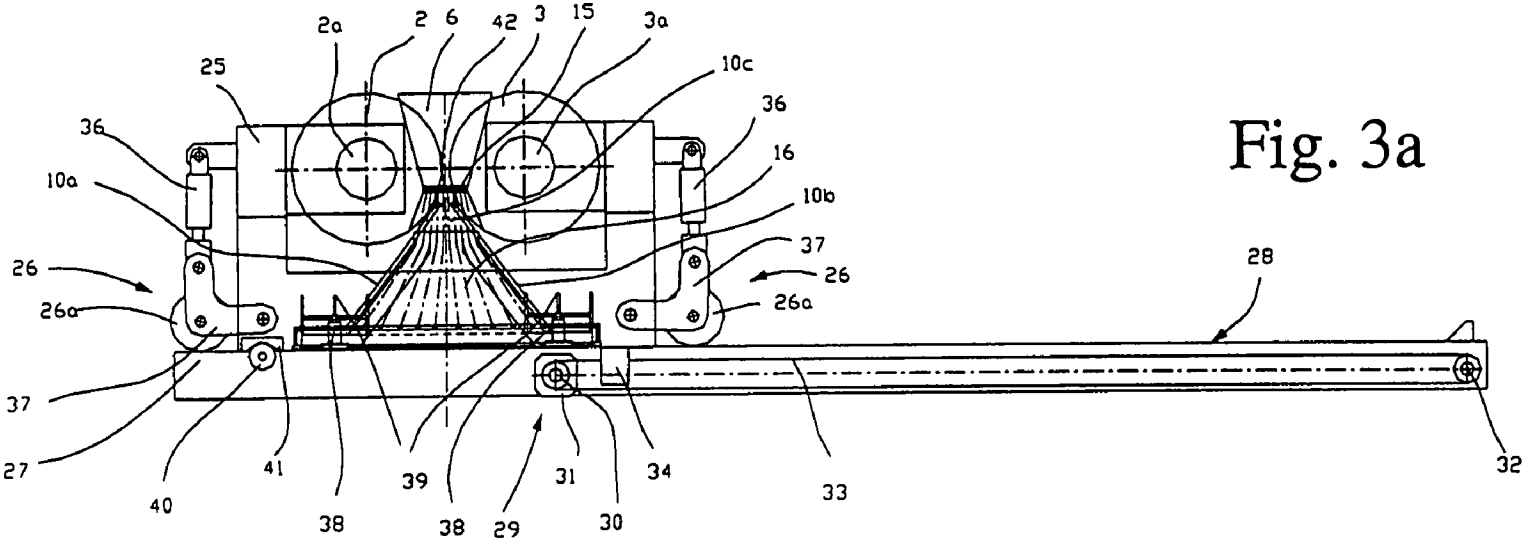
Figure 3B:
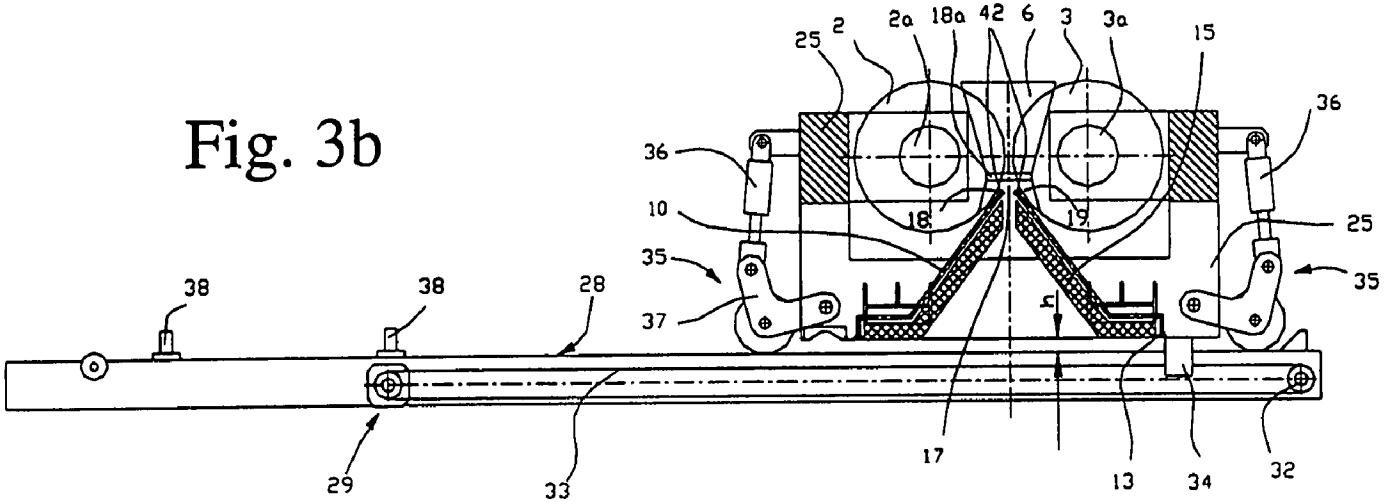

As illustrated in FIG. 3*a* and 3*b*, at the two end sides of the casting rolls 2, 3, walls 10*c*, 10*d* of the casting-roll shield 10 project upward at a short distance from these end sides, delimiting the outlet region of the casting gap 4 at the bottom parallel to the narrow sides of the cast strip. The edges of these walls 10*c*, 10*d* bear seals 42 which cover the short distance or gap with respect to the casting-roll end sides, and these seals 42 may also be arranged in the edge region with respect to the side seals 6 which are to be pressed on or between the projecting walls 10*c*, 10*d* and the side seals 6 which can be pressed on.

In addition, the casting-roll shield 10 bears, on that side of its walls 10*a*, 10*b* which is assigned to the interior space 14 of the housing 9, respective nozzles 22, 23, from which, in casting operation, a gas stream G consisting of an inert gas or of a mixture of an inert gas and a reducing gas is in each case blown into the interior space 14 of the housing 9. The nozzles 22, 23 are in this case oriented in such a manner that at least some of the gas stream G emerging from them sweeps over the surface of the cast steel strip B.

At a distance below the channel 12, an opening, to which an extraction pipe 24 leading to an extractor device (not shown) is connected, is formed integrally into a side wall of the housing 9.

The casting-roll shield 10 is secured to a frame 25, which bears the casting rolls 2, 3 supported in casting-roll bearings 2*a*, 3*a* and other units which are not shown here and are required to supply and drive the casting rolls 2, 3. The frame 25, together with the casting rolls 2, 3 which it carries, the casting-roll shield 10 and the other units, can be transported out of its working position illustrated in the figures into a waiting position (not shown) in which maintenance work is carried out.

The casting rolls 2, 3, which are supported on a frame 25, and the casting-roll shield 10, which is releasably connected to the frame 25, are diagrammatically depicted in a working position in FIG. 3*a*, in which the casting operation is carried out, and in a waiting position in FIG. 3*b*, in which maintenance work, in particular a casting roll change and a change of the casting-roll shield, are carried out.

To jointly displace the casting rolls 2, 3 and the casting-roll shield 10 between a working position and a waiting position, the frame 25 is equipped with a running mechanism 26 with rail-borne wheels 26*a*, the wheels 26*a* being supported on a stationary running track 28, which preferably bears rails. A running drive 29 for the running mechanism 26 is secured to the intermediate plate 27. The running drive 29 comprises a drive wheel 30, which is configured as a chain wheel and is coupled to a drive motor 31, and a diverter wheel 32, which is formed as a chain wheel and is connected to the drive wheel 31 via a revolving drive chain 33. The frame 25, the casting rolls 2, 3 and the casting-roll shield 10 can be transported from an operating position into a waiting position and back by a drive mandrel 34 which engages displaceably in the driving chain 33 and is anchored to the frame 25. The driving mandrel 34 which engages displaceably in the driving chain 33 allows the frame 25 to be raised with respect to the intermediate plate 27 without interruption to the running drive 29. To raise the lower edge of the casting-roll shield 10 out of the sand-filled channel 12 of the seal 13, the running mechanism 26 is assigned a lifting or pivoting mechanism 35, which raises the frame 25 with respect to the running mechanism 26 and/or the intermediate plate 27 and allows initial displacement between the working position and the waiting position. The lifting or pivoting mechanism is either actuated by lifting cylinders which are arranged between the running mechanism and the frame and raise the frame vertically along guides (not shown), or the wheel sets of the running mechanisms 26 are supported pivotably in pivot levers 37, one end of which is articulatedly mounted on the frame 25, while the other end is actuated by piston-cylinder units 36, so that the frame 25 and the casting-roll shield 10 are likewise raised.

To fix the frame 25 without play in the working position, centering bolts 38 on the intermediate plate 27 project upward and engage in lateral centering grooves 39 in the frame 25 when the frame 25 is lowered onto the intermediate plate 27. Furthermore, a centering wheel 40 is secured to the intermediate plate and engages in a transverse centering groove 41 with inclined flanks on the frame 25 when the frame 25 is being lowered. These centering devices accurately center the frame 25 in two directions which are normal to one another on the intermediate plate. To transfer the frame from the working position into the waiting position, the frame 25 resting on the intermediate plate 27 is raised in the vertical direction by the displacement height h until the centering devices acting between the frame and the intermediate plate are disengaged. In the waiting position, the frame 25 can remain in the raised position or may preferably be put down on a working plate, which in FIG. 3*b* is part of the intermediate plate.

Figure 5:
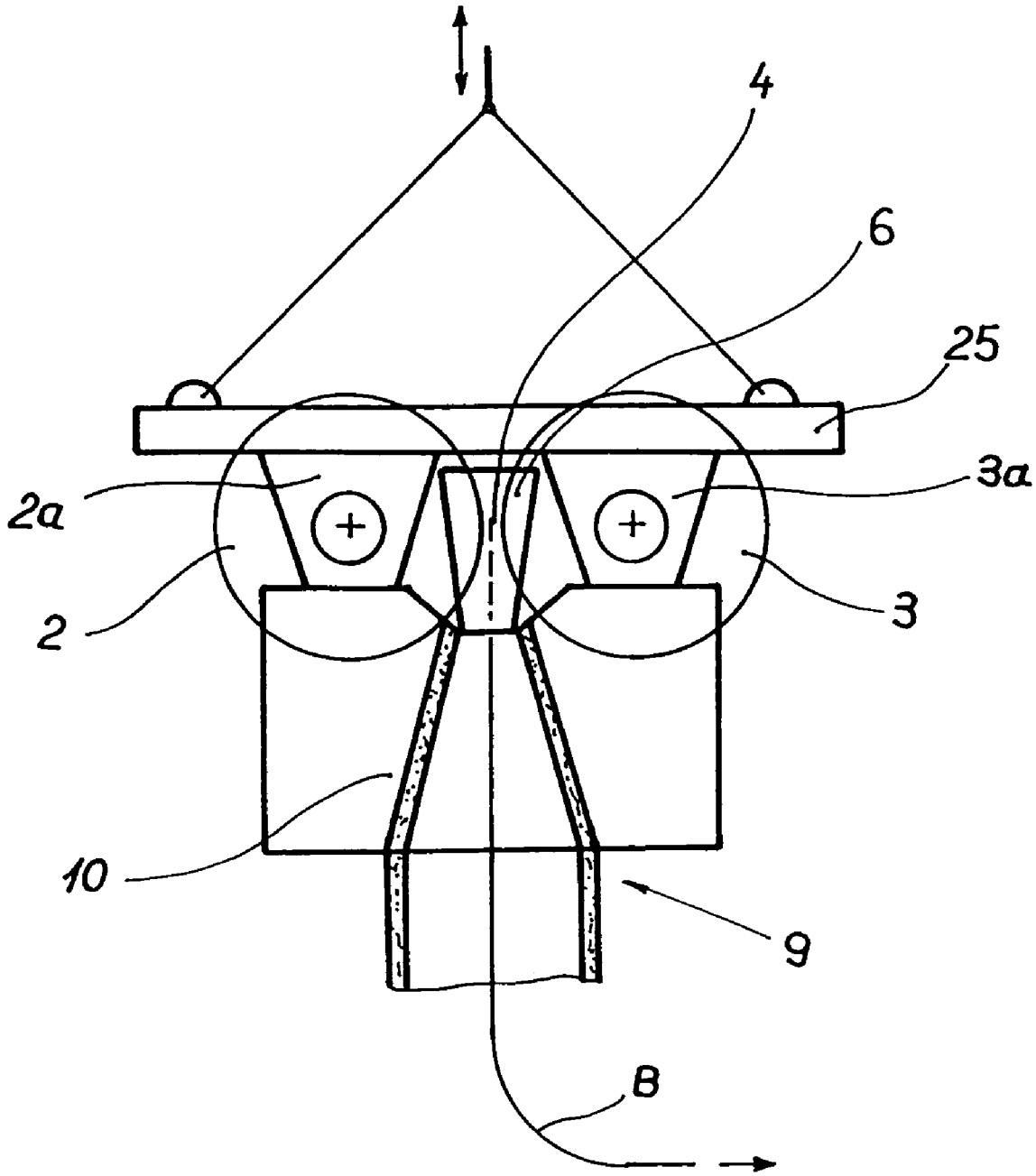

FIG. 5 diagrammatically depicts a further embodiment of the assembly, comprising casting rolls 2, 3, casting-roll bearings 2*a*, 3*a*, a frame 25 and a casting-roll shield 10. This assembly can be displaced from a working position, in which the casting operation takes place, into a waiting position, in which, for example, maintenance work is carried out, and back.

The casting rolls 2, 3, which form a casting gap 4, are supported in casting-roll bearings 2*a*, 3*a*, which for their part are suspended from the frame 25 and are adjustably secured. Side seals 6*a* can be pressed on in order to laterally seal the casting gap 4. The steel strip B which is drawn out of the casting gap 4 is surrounded over its conveying path by a housing 9, on which a casting-roll shield 10, which in detail is designed in a similar manner to the embodiment shown in FIG. 1 to 3*a* and 3*b*, rests in the outlet region of the steel strip from the casting rolls. The casting-roll shield 10 is substantially secured to the casting-roll bearings 2*a*, 3*a*, with the securing allowing the position of one of the two casting rolls to be altered in order to change the horizontal distance between the casting rolls. In a similar manner to in the embodiment shown in FIG. 3*a* and 3*b*, the assembly can be displaced by a running mechanism with lifting device secured to the frame or, as indicated in FIG. 5, by means of a lifting mechanism designed as a crane.

During casting operation, the cast steel strip B, as illustrated in FIG. 1 and 2, is continuously drawn out of the casting gap 4 and is likewise continuously conveyed over the conveying path 7 to the hot-rolling stand 8. An inert gas atmosphere prevails in the housing 9, preventing the formation of scale on the surface of the cast steel strip B. Gas which is present in the housing 9 and comes into contact with the hot cast strip is heated and, on account of its increase in temperature, rises as hot-gas streams T in the opposite direction to the conveying direction F in the casting-roll housing 9.

Meanwhile, further inert gas at a low temperature is constantly being blown via the nozzles 22, 23 into the cooling zone K which is formed beneath the shield, as seen in the conveying direction F of the cast steel strip B, and is laterally delimited by the shield. The gas stream G which is blown in sweeps over the surface of the cast steel strip B immediately after the latter leaves the casting gap 4, thereby producing targeted cooling of the strip surface.

As a result of the cool gas stream G being blown in, the surface of the cast steel strip B being cooled and the walls 10*a*, 10*b* of the casting-roll shield 10 being cooled continuously, a temperature which is lower than the temperature of the hot-gas stream T is constantly maintained in the cooling zone K. Consequently, the hot-gas stream T which enters the cooling zone K and is mixed with the cooling-gas stream G is cooled, so that its rising motion is interrupted. The gas volumes which build up in front of the cooling zone K and are formed from the gas streams G and T are extracted via the extraction tube 24.

Forming the cooling zone K, which is delimited by the shield 10, in the immediate vicinity of the casting rolls 2, 3 therefore prevents the hot-gas stream T from heating the frame 25 and the devices and units secured to it and from endangering people working at the apparatus 1.

At the same time, the permanent cooling of the walls 10*a*, 10*b* of the casting-roll shield 10 ensures that the thermal loads on the latter, despite the thermal radiation emitted by the cast steel strip B, are so low that they retain their shape even in casting operation. This ensures a permanently tight seal between the casting rolls 2, 3 and the edges 18, 19 of the inlet opening 17.

Finally, the blowing of inert cooling gas into the housing 9 suppresses the formation of large quantities of scale on the surface of the cast steel strip B.

As a result, it is in this way possible to produce a cast steel strip B which, while allowing rapid manipulation of the casting rolls and minimizing the loading on the apparatus used to produce it and the staff working at this apparatus, has a surface condition which makes the strip particularly suitable for further processing.

The invention claimed is:

1. An apparatus for casting metal melt to form a cast strip, comprising:

two casting rolls, which are arranged axially parallel, are rotatable in opposite directions during a casting operation, delimit the longitudinal sides of a casting gap formed between the casting rolls;

a frame having casting-roll bearings on which the casting rolls are supported rotatably and axially parallel, the frame being displaceable between a working position and a waiting position;

a transport path for transporting away the cast strip emerging from the casting gap, and a casting roll shield carried by the frame, the shield being arranged beneath the two casting rolls and the casting gap, the shield has an inlet opening for passage of the cast strip past the shield, wherein the casting roll shield includes walls, and the inlet opening is defined by edges of the walls, and edges of the walls of the casting-roll shield extend at end sides of the casting rolls, with the edges of the walls being arranged to form a gap with respect to the end sides of casting rolls.

2. The apparatus as claimed in claim 1, wherein the casting-roll bearings receive the casting rolls, the bearings are located on the frame, and the casting-roll shield adjoins the frame.

3. The apparatus as claimed in claim 1, wherein the casting-roll bearings receive the casting rolls, the bearings are engaged in a suspended manner on the frame, and the casting-roll shield is secured to the casting-roll bearings.

4. The apparatus as claimed in claim 1, wherein the casting-roll shield is matched to dimensions of the casting rolls.

5. The apparatus as claimed in claim 1, wherein the casting-roll shield has a shape of a ridged roof and extends within a space which is delimited by the casting rolls and is located beneath the casting gap.

6. The apparatus as claimed in claim 1, wherein the casting rolls have end sides and the inlet opening of the casting-roll shield is defined by edges which extend axially parallel to the casting rolls and are arranged to form a gap with respect to the end sides of casting rolls.

7. The apparatus as claimed in claim 1, further comprising a seal arranged between the edges of the casting-roll shield and the casting rolls.

8. The apparatus as claimed in claim 7, wherein each casting roll has a surface and the seal comprises a flexible, low-abrasion strip or a brush which touches the casting-roll surface or is at a distance of less than 4 mm from the casting roll surface.

9. The apparatus as claimed in claim 1, wherein the cross section of the inlet opening of the shield is matched to the cross section of the cast strip.

10. The apparatus as claimed in claim 1, further comprising a housing which adjoins the casting-roll shield and together with the casting-roll shield surrounds the conveying path of the cast strip emerging from the casting gap at least over a section of the conveying path which starts from the outlet region of the casting gap.

11. The apparatus as claimed in claim 10, further comprising a first device arranged in the conveying path for conveying away or hot-rolling the strip; the casting-roll shield, together with the housing, surrounds the conveying path of the cast strip at least as far as the first device.

12. The apparatus as claimed in claim 11, wherein the casting-roll shield is releasably connected to the first device.

13. The apparatus as claimed in claim 12, further comprising a seal between the casting-roll shield and the housing.

14. The apparatus as claimed in claim 13, wherein the seal is designed to be closable by the casting-roll shield being lowered onto the housing.

15. The apparatus as claimed in claim 13, wherein the casting roll shield has a lower edge; the seal comprises a sand-filled channel in which the lower edge of the casting-roll shield stands.

16. The apparatus as claimed claim 1, wherein the frame which receives the casting-roll bearings includes a transport device, operable for moving the frame between the working position and the waiting position.

17. The apparatus of claim 1, further comprising a seal arranged between the edges of the casting-roll shield and the casting rolls.

18. The apparatus as claimed in claim 17, wherein the frame which receives the casting-roll bearings is height adjustable with respect to the transport device.

19. The apparatus as claimed in claim 16, wherein the frame which receives the casting-roll bearings is height adjustable with respect to the transport device; and the frame in the working position thereof rests in a centered position on an intermediate plate, and when the frame is to be displaced into the waiting position, the plate is movable into a raised position with respect to the intermediate plate.

20. The apparatus as claimed in claim 1, wherein the casting-roll shield delimits a cooling zone, in which temperature during casting is lower than the temperature of gases heated by the cast strip.

21. The apparatus as claimed in claim 1, wherein the casting-roll shield has at least one wall connected to a coolant supply device.

22. The apparatus as claimed in claim 21, wherein the wall has at least one cooling passage through which cooling fluid flows at least during a casting operation.

23. The apparatus as claimed in claim 20, further comprising at least one device for blowing cooling gas into the cooling zone.

24. The apparatus as claimed in claim 23, wherein flow of cooling gas blown into the cooling zone is directed by the at least one device substantially in the opposite direction to the direction of flow of gases heated by the cast strip.

25. The apparatus as claimed in claim 24, wherein the flow of cooling gas which is blown in at least partially strikes a surface of the cast strip and at least partially sweeps over the surface.

26. The apparatus as claimed in claim 23, wherein the cooling gas is inert.

27. The apparatus as claimed in claim 23, wherein the cooling gas has a reducing action.

28. The apparatus as claimed in claim 1, further comprising nozzles for providing a stream of gas directed to prevent gas from escaping from the inlet opening during casting, the nozzles are arranged in the region of the inlet opening of the casting-roll shield.

29. The apparatus as claimed in claim 1, wherein the casting-roll shield extends in the width direction of the cast strip, and laterally with respect to the casting rolls.

30. The apparatus as claimed in claim 1, wherein the casting-roll shield includes surfaces covered or coated with a refractory material on the surfaces of the shield assigned to the cast strip.

31. The apparatus as claimed in claim 1, further comprising an extractor device for extracting the gases heated by the cast strip.

32. The apparatus as claimed in claim 10, wherein the housing has an extraction opening, and the extractor device connected to the extraction opening for extracting the gases by the cast strip.

33. The apparatus of claim 16, wherein the transport device comprises a running mechanism supported on a running track.

34. The apparatus of claim 18, wherein the frame height with respect to the transport device is adjustable by a lifting or pivoting mechanism.

35. The apparatus of claim 21, wherein the at least one cooled wall has at least one cooling passage through which cooling fluid flows at least during a casting operation.

36. The apparatus of claim 23, wherein the flow of cooling gas which is blown in at least partially strikes the surface of the cast strip and at least partially sweeps over the surface.

37. The apparatus of claim 28, wherein the nozzles are one of fan-jet nozzles and round-jet nozzles.

* * * * *

UNITED STATES PATENT AND TRADEMARK OFFICE

CERTIFICATE OF CORRECTION

PATENT NO. : 7,048,032 B2
APPLICATION NO. : 10/505801
DATED : May 23, 2006
INVENTOR(S) : Hohenbichler et al.

It is certified that error appears in the above-identified patent and that said Letters Patent is hereby corrected as shown below:

Title page, should read;

(22) PCT Filed: Feb. 26, 2003

Signed and Sealed this

Twelfth Day of September, 2006

JON W. DUDAS
*Director of the United States Patent and Trademark Office*